US007533931B1

(12) United States Patent
Bryant, Sr.

(10) Patent No.: US 7,533,931 B1
(45) Date of Patent: May 19, 2009

(54) BEVERAGE CONTAINER HOLDER FOR A FISHING BOAT PEDESTAL SEAT

(76) Inventor: Richard M. Bryant, Sr., 1355 Dora Rd., Brooksville, MS (US) 39839

( * ) Notice: Subject to any disclaimer, the term of this patent is extended or adjusted under 35 U.S.C. 154(b) by 0 days.

(21) Appl. No.: 12/007,184

(22) Filed: Jan. 8, 2008

(51) Int. Cl.
*A47C 7/62* (2006.01)

(52) U.S. Cl. ..... 297/188.08; 297/188.2

(58) Field of Classification Search ..... 297/188.08, 297/188.2
See application file for complete search history.

(56) References Cited

U.S. PATENT DOCUMENTS 87,989 A 2/1908 Pokormy ..... 297/188.08
4,063,701 A * 12/1977 Wray ..... 297/188.2
4,500,059 A * 2/1985 Papizan ..... 297/188.2 X
4,560,128 A * 12/1985 Willeby et al. ..... 297/188.2
4,745,704 A 5/1988 Schaefer ..... 43/54.1
5,481,822 A * 1/1996 Engels ..... 297/188.12 X
5,586,804 A 12/1996 Burroughs ..... 297/188.08
5,597,148 A 1/1997 Gospodarich ..... 297/188.2

* cited by examiner

*Primary Examiner*—Anthony D Barfield
(74) *Attorney, Agent, or Firm*—James G. O'Boyle, Esq.

(57) ABSTRACT

A beverage container holder for a fishing boat pedestal seat wherein a horizontally extending arm has one end connected to the seat pedestal and a cylindrical beverage container holder secured to the radially outwardly portion of the arm. The container holder and associated arm can be freely rotatable relative to the seat or fastened thereto and movable therewith A seat is provided in the cylindrical sidewall of the container holder for accommodating a handle on the beverage container.

3 Claims, 2 Drawing Sheets

BEVERAGE CONTAINER HOLDER FOR A FISHING BOAT PEDESTAL SEAT

BACKGROUND OF THE INVENTION

A fisherman sitting on a conventional pedestal mounted seat on a boat while holding a beverage container has nowhere to place the container to free his hands when casting or when a fish strikes the line. He can place the beverage container on the deck adjacent the chair, which will result in wasted time, particularly when landing a fish, and can also result in the beverage being spilled.

SUMMARY OF THE INVENTION

After considerable research and experimentation, the beverage container holder of the present invention has been devised for a fishing boat pedestal seat and comprises, essentially, a horizontally extending arm having a hole in one end thereof adapted to receive a depending shaft secured to the bottom of the seat, whereby the arm extends radially outwardly from the seat and associated shaft. A cylindrical beverage container holder is secured to the radially outwardly extending portion of the arm. The horizontally extending arm and associated container holder can be freely rotatable on the shaft so that the container holder can be moved, relative to the seat, to an out-of-the way position, or the arm can be fastened to the bottom of the seat to thereby secure the holder in a fixed position relative to the seat.

DESCRIPTION OF THE PREFERRED EMBODIMENT

Figure 1:
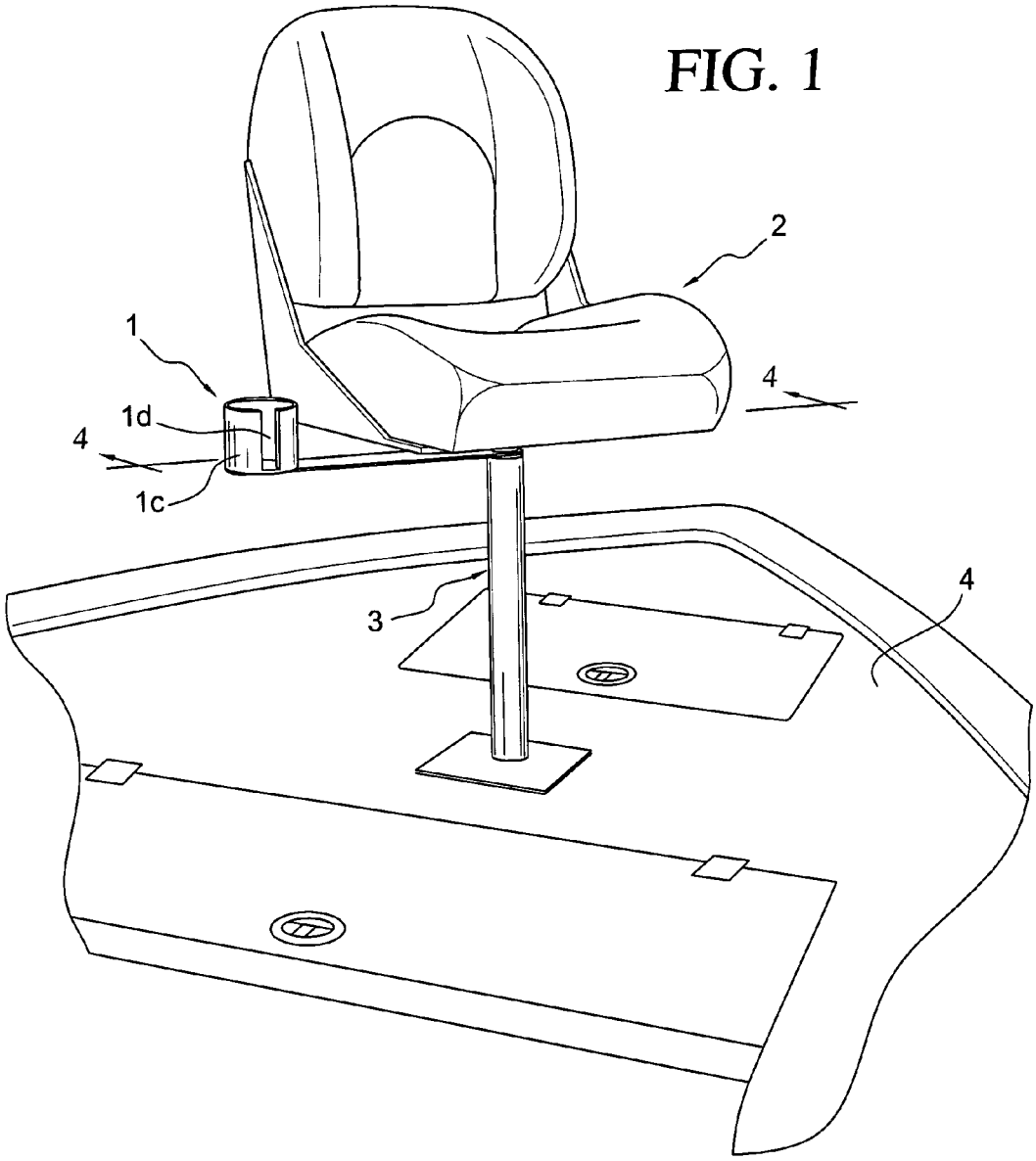
FIG. 1 is a perspective view of the beverage container holder of the present invention mounted on a fishing boat pedestal seat.

Referring to the drawings and more particularly to FIG. 1, the beverage container holder 1 of the present invention, is mounted adjacent a seat 2 supported by a tubular pedestal 3 fixedly secured to a boat deck 4.

Figure 2:
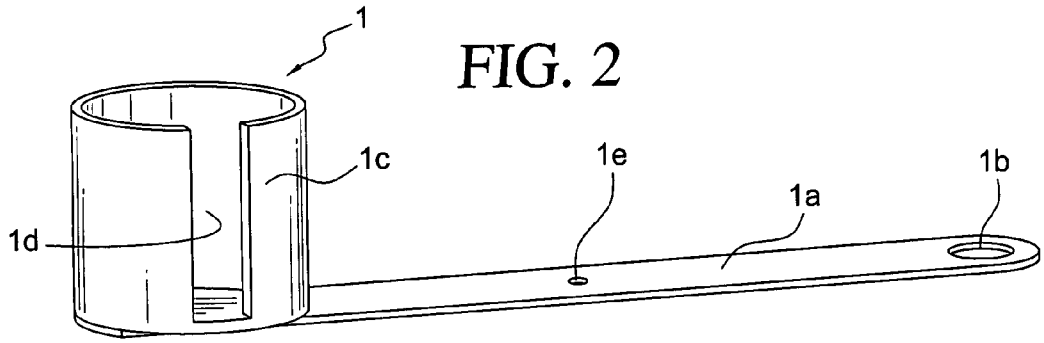
FIG. 2 is a perspective view of the container holder and associated supporting arm.
Figure 3:
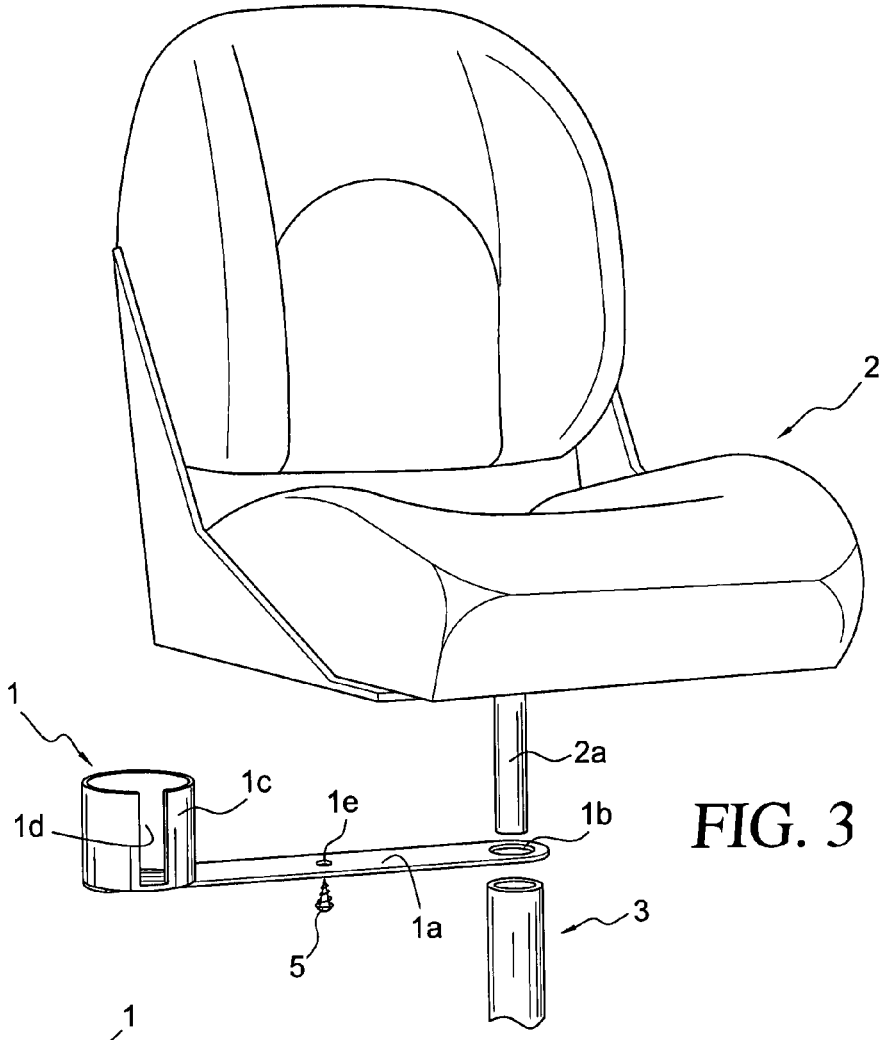
FIG. 3 is an exploded perspective view of the pedestal seat and the container holder shown in FIG. 1.
Figure 4:
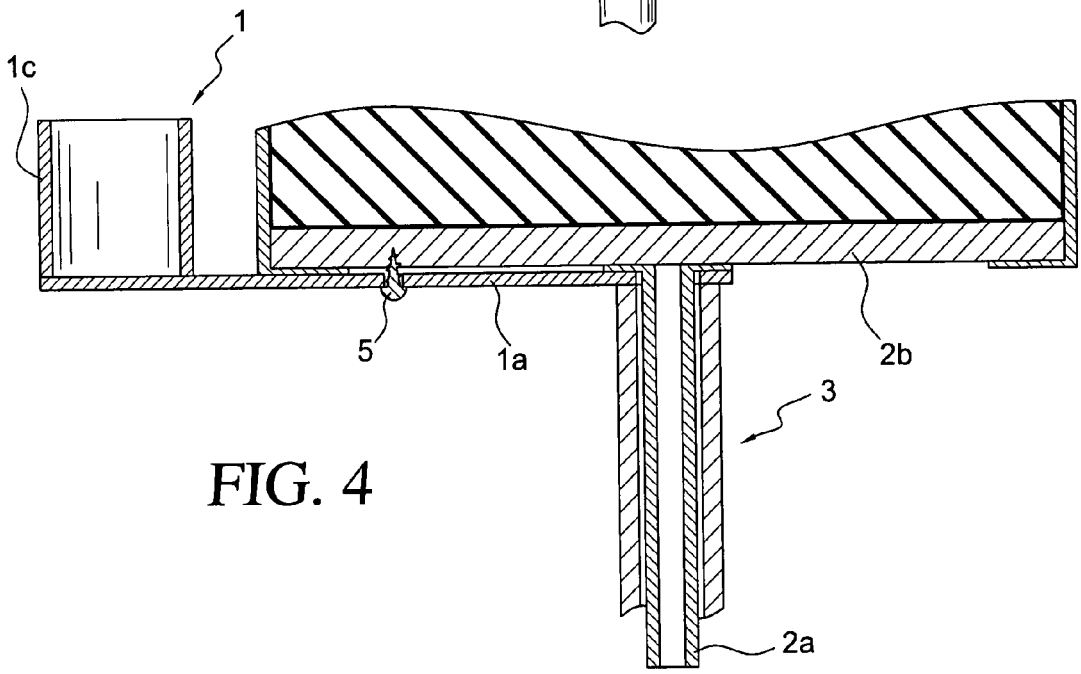
FIG. 4 is a fragmentary sectional, side elevational view showing the container holder and associated supporting arm secured to the bottom of the pedestal seat.

The details of the construction of the beverage container holder 1 and its connection to the seat 2 are illustrated in FIGS. 2 to 4, wherein it will be seen that the holder 1 comprises a horizontally extending arm 1*a* having a hole 1*b* in one end thereof adapted to receive a depending shaft 2*a* secured to the bottom of the seat 2, the shaft 2*a* extending into the upper end portion of the tubular pedestal 3 and being rotatable therein, as shown in FIG. 4.

A cylindrical holder 1*c* for a beverage container is secured to the opposite end of the arm 1*a*, and a slot 1*d* is provided the cylindrical sidewall of the holder 1*c* to accommodate a handle on the beverage container.

The horizontally extending arm 1*a* and associated container holder 1*c* can be freely rotatable on the shaft 2*a* so that the container holder 1*c* can be moved relative to the seat 2 to an out-of-the way position, or the arm 1*a* can be secured to the bottom of the seat 2 by a fastener 5 extending through a hole 1*e*, provided in the arm 1*a*, and into the bottom 2*b* of the seat 2, as shown in FIG. 4.

From the above description, it will be appreciated by those skilled in the art that the beverage container holder of the present invention provides an improved beverage container holder for a pedestal seat mounted on a fishing boat, wherein the holder is adapted to move relative to the seat to an out-of-the way position relative to the fisherman, or it can be fastened to the seat.

It is to be understood that the form of the invention herewith shown and described is to be taken as a preferred example of the same, and that various changes in the shape, size, and arrangement of parts may be resorted to without departing from the spirit of the invention or scope of the subjoined claims.

I claim:

1. In combination, a beverage container holder and a pedestal supported seat having a depending shaft and a vertically extending tubular pedestal, said depending shaft extending into the upper end portion of the tubular pedestal and being rotatable therein, said beverage container holder comprising a horizontally extending single piece arm, an integral hole formed in one end of said arm, the depending shaft extending through said hole, a cylindrical holder for a beverage container secured to the opposite end of said arm, whereby the horizontally extending arm and associated cylindrical holder are freely rotatable on said depending shaft so that the cylindrical holder can be moved relative to the seat to an out-of-the way position.

2. The combination of a beverage container holder and a pedestal supported seat, according to claim 1, wherein a fastener extends through the horizontally extending arm and into the bottom of the seat, whereby the beverage container holder is secured to the seat and rotatable therewith.

3. The combination of a beverage container holder and a pedestal supported seat, according to claim 1, wherein a slot is provided in the cylinder sidewall of the holder for accommodating a handle on the beverage container.

* * * * *